US005316150A

United States Patent [19]

Fisher

[11] Patent Number: 5,316,150

[45] Date of Patent: May 31, 1994

[54] FIBER SEPARATION PROCESS

[76] Inventor: Gordon Fisher, P.O. Box 577, Corcoran, Calif. 93212

[21] Appl. No.: 25,262

[22] Filed: Mar. 2, 1993

[51] Int. Cl.[5] ..... B07B 9/00

[52] U.S. Cl. ..... 209/30; 209/33; 209/23

[58] Field of Search ..... 209/12, 30, 31, 33, 209/44.1, 44.3, 22, 23

[56] References Cited

U.S. PATENT DOCUMENTS

| | | | |
|---|---|---|---|
| 1,624,717 | 4/1927 | Davis | 209/30 |
| 3,854,585 | 12/1974 | Herkes | 209/12 X |
| 4,300,267 | 11/1981 | Winch et al. | 209/22 X |
| 4,382,857 | 5/1983 | Laughlin | 209/31 X |

FOREIGN PATENT DOCUMENTS

| | | | |
|---|---|---|---|
| 214054 | 8/1960 | Austria | 209/31 |

*Primary Examiner*—David H. Bollinger
*Attorney, Agent, or Firm*—Mark D. Miller

[57] ABSTRACT

A method for separating the long outer bast fibers from the short woody inner core fibers of herbaceous fiber producing plants which includes the steps of requiring that such plants harvested at a certain cut length are processed through a first and second stage core separator, each of which includes a rotating spiked cylinder and a set of angled moving conveyors for coarse separation of the bast and core fibers; then processed through a first and second incline core separator each of which include a series of rotating spiked cylinders provided at an inclined angle; then introduced into a single saw separator; then passed through a jet air separator having an adjustable blade therein; and finally, run through a four cylinder fiber cleaner. Each of these steps provides further and more complete separation of the woody core fibers from the longer bast fibers so that by the time the bast fibers exit the four cylinder cleaner they are over ninety-eight percent (98%) free of the woody core fibers. The core fibers which exit the various separators of the process are all channeled into a hammermill for grinding, and then transported into a large tilted rotating screened core fiber sizing drum.

18 Claims, 7 Drawing Sheets

FIBER SEPARATION PROCESS

BACKGROUND OF THE INVENTION

The present invention relates to fiber separation methods and apparatus, and more particularly to a new process for mechanically separating the longer outer bast fibers from the shorter woody innercore fibers of annual herbaceous fiber producing plants.

The long outer bast fibers of annual herbaceous fiber producing plants such as Kenaf and Crotalaria are desirable for a number of uses, including, among other things: use as a packing material; use as a material for the manufacturing of carpet pads and other non-woven pads; use as a product from which high grade paper can be manufactured; use as an absorbing medium for liquids such as water and oil; use in producing rope and cordage products; use in bio-degradable netting products for preventing soil erosion; jute bags; and burlap.

Cleanly separating these useful longer outer bast fibers from the short woody innercore fibers of such plants is necessary in order for such fibers to be used in paper, packing, non-woven pads and cordage materials. The clean outer bast fibers are softer and hemp-like; whereas, the innercore fibers are harder, more rough and woody. Thus, the cleaner the bast fibers, the more readily they may be employed as packing materials, pads, paper products and the like. Once separated, the short woody innercore materials may also be used for such things as a bedding medium for animals, potting mix, or oil absorption materials.

Current methods of processing Kenaf, Crotalaria and other related herbaceous fiber producing plants employ the use of a hollow revolving screened cylinder inside an enclosure for separation. This method leaves an unacceptably high percentage (sometimes as much as 20%) of the short woody innercore fibers in the processed product. Unless the final product is approximately 98% clean of the innercore fibers, it cannot be used in making packing materials, pads, paper products, cordage and the other applications described above. Reintroducing the processed product into the revolving screened cylinder time after time may ultimately achieve a separation of perhaps 90%. However, this is still far below the standard necessary for use in the above products, and the continual re-introduction process is costly and time consuming.

SUMMARY OF THE INVENTION

The present invention provides a straight forward one-pass method for cleanly separating up to ninety-eight percent (98%) of the short woody innercore (core) fibers from the desirable longer outer bast (bast) fibers of Kenaf, Crotalaria and other related herbaceous fiber producing plants. The method requires that the plants be harvested at a certain cut length. The harvested plants are then processed through a first and second stage core separator (see FIG. 1), each of which includes a rotating spiked cylinder and a set of angled moving conveyors for coarse separation of the bast and core fibers. The output bast fibers are then processed through a first and second incline core separator (see FIG. 2), each of which include a series of rotating spiked cylinders provided at an inclined angle. The incline core separators further remove the core fibers from the bast fibers.

The output bast fibers are next introduced into a single saw separator, and then passed through a jet air separator having an adjustable blade therein. Finally, the bast fibers run through a four cylinder fiber cleaner. Each of these steps provides further and more complete separation of the woody core fibers from the longer bast fibers so that by the time the bast fibers exit the four cylinder cleaner (see FIG. 3) they are over ninety-eight percent (98%) free of the woody core fibers. At this stage the fibers are baled and made ready for shipment.

The core fibers which exit the various separators of the process are all channeled into a hammermill for grinding, and then transported into a large tilted rotating screened core fiber sizing drum (see FIG. 5). As the core fibers are tossed about inside the screened drum, a sizing of coarse and fine core fibers occurs. Some bast fibers are also separated from the core fibers here and returned to the main process for bailing.

It is therefore a primary object of the present invention to provide a method for mechanically separating the outer bast fibers from the woody innercore fibers of annual herbaceous fiber producing plants.

It is a further primary object of the present invention to provide a method for mechanically separating over ninety-eight percent (98%) of the longer outer bast fibers from the shorter woody innercore fibers of annual herbaceous fiber producing plants.

It is a further object of the present invention to provide a reliable mechanical method for cleanly separating longer outer bast fibers from shorter woody innercore fibers of annual herbaceous fiber producing plants.

It is a further object of the present invention to provide a reliable mechanical method for producing long bast fibers from annual herbaceous fiber producing plants that are ninety-eight percent (98%) free of short woody innercore fibers.

It is a further object of the present invention to provide a reliable mechanical method for producing long bast fibers from annual herbaceous fiber producing plants that are sufficiently free of short woody innercore fibers that they may be used in producing packing materials, pads, paper products, absorption media, rope and cordage products, bio-degradable netting for soil improvement and anti-erosion, jute bags, burlap and the like.

It is a further object of the present invention to provide a method for producing clean short woody innercore fibers from annual herbaceous fiber producing plants.

It is a further object of the present invention to provide a method for producing short woody innercore fibers from annual herbaceous fiber producing plants that are sufficiently clean that they may be used for such things as a bedding medium for animals, potting mix, oil absorption materials, and the like.

Additional objects of the invention will be apparent from the detailed descriptions and the claims herein.

DETAILED DESCRIPTION OF THE DRAWINGS

Figure 1:
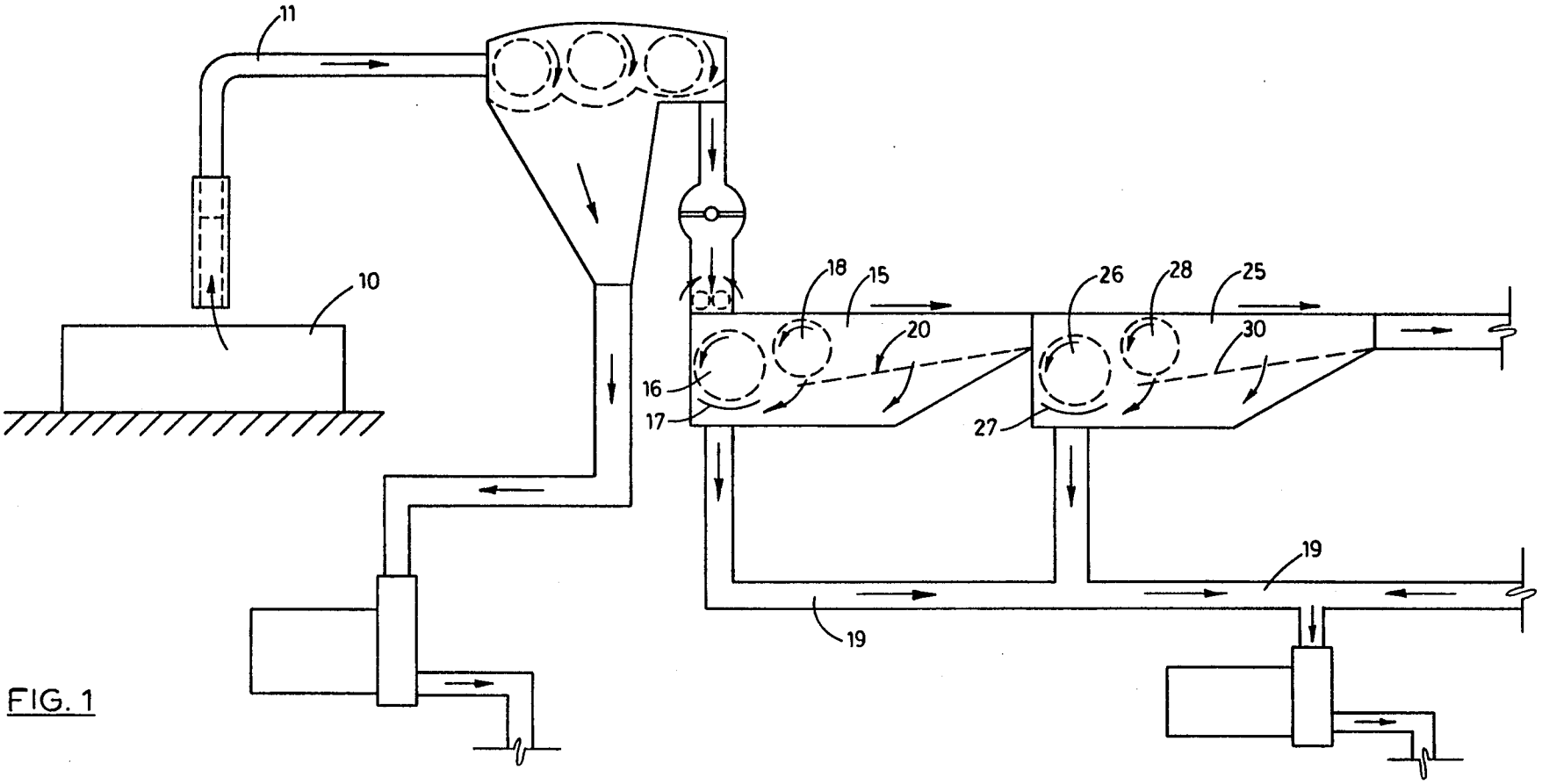
FIG. 1 is diagrammatic side view of a machine equipped with an unloading air separator, first stage core separator, second stage core separator, and discharge tubes for core fibers.
Figure 2:
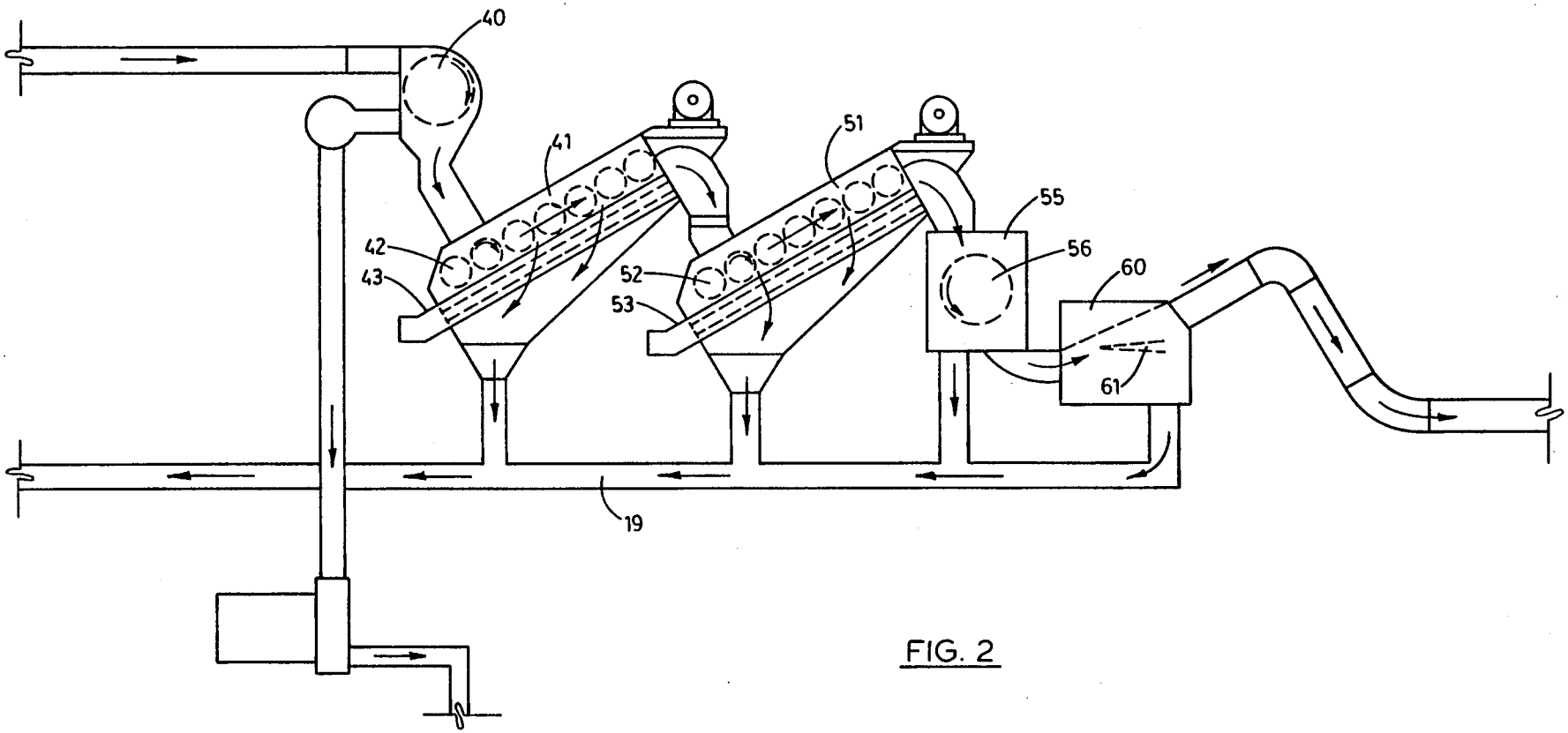
FIG. 2 is a diagrammatic side view of a machine equipped with an unloading air separator, a first incline core separator, a second incline core separator, a saw cleaner and a jet air fiber separator (with discharge tubes for core fibers).
Figure 3:
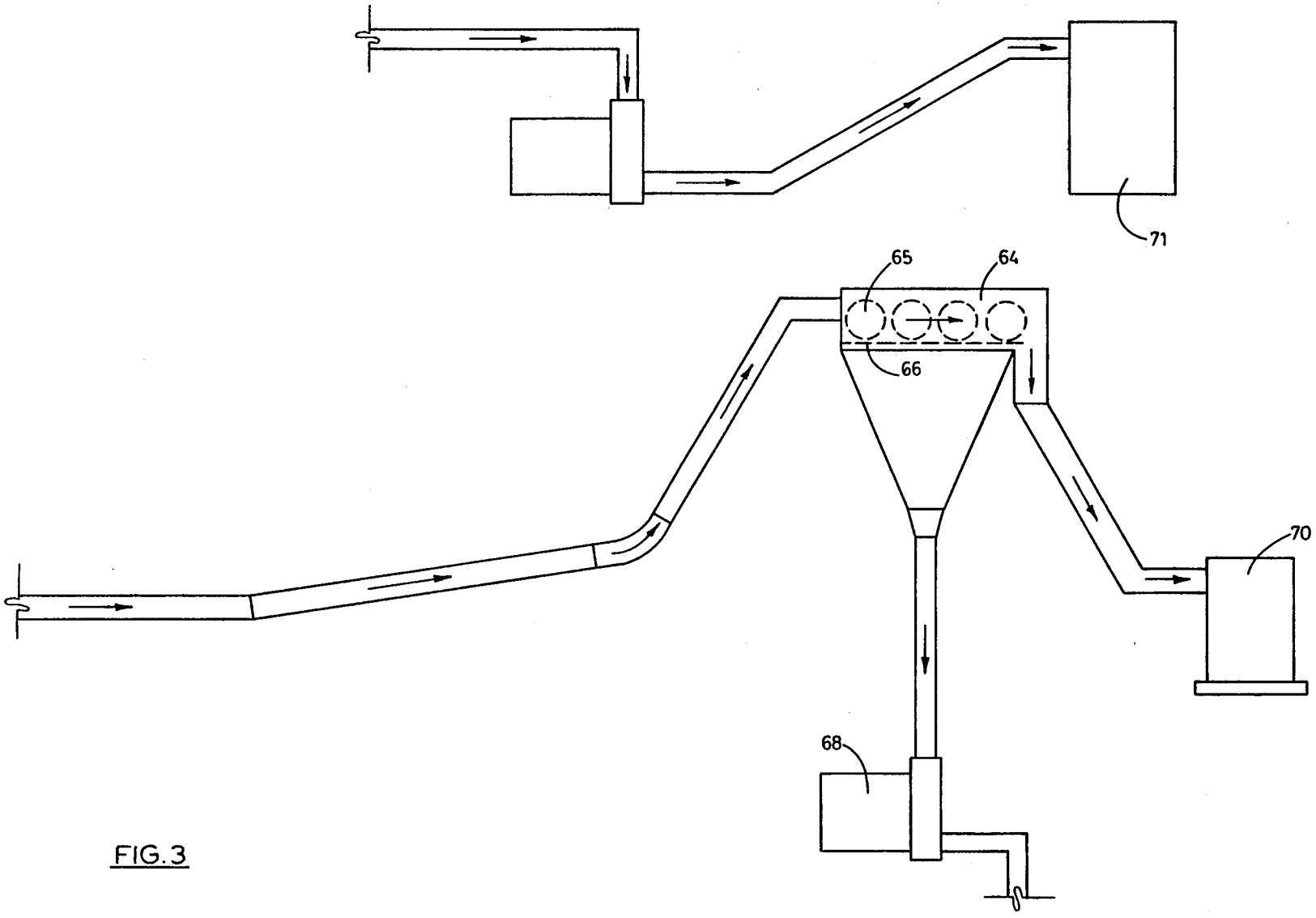
FIG. 3 is a diagrammatic side view of a machine equipped with a four cylinder fiber cleaner and a bale fiber press.

Referring to the drawings wherein like reference characters designate like or corresponding parts throughout the several views, and referring particularly to FIGS. 1, 2 and 3, it is seen that a suction tube (11) at the processing plant pulls the harvested fibers from the module (10) and feeds the fibers into a first stage core separator (15). This separator includes a rotating cylinder (16), having a plurality of rows of spiked teeth protruding outwardly therefrom mounted inside a slightly larger cylindrical housing (17) which partially surrounds the spiked cylinder. The housing is open at the top which allows the harvested fibers to enter, and is closed along one side where the cylinder rotates downward. At the bottom of the housing a set of several rows of spiked teeth are provided protruding inwardly therefrom towards the rotating cylinder. As the first cylinder rotates within the housing, the sets of spiked teeth thereon intermesh in very close proximity with the spiked teeth on said housing. As the herbaceous fibers pass between the rapidly moving teeth of the cylinder and the stationary teeth of the housing, the core fibers are broken away from the bast fibers.

A grooved concave grate is provided beginning at the bottom of the housing and extending upward around approximately one fourth (¼) of the rotating cylinder. As the fibers travel around the cylinder, centrifugal force throws a significant volume of the core pieces down and through the grooved grate. The core pieces then travel through a separate series of suction tubes (19) to a rotating core fiber separator (discussed more fully below). The remaining bast fibers are caught in the grooved grate and continue upward until they reach a second, smaller rotating cylinder (18) within the first stage core separator. This second cylinder is provided slightly above and next to the first, spiked cylinder. The second cylinder has an uneven surface and rotates in the same direction as the spiked cylinder. This rotation creates an air flow which pulls the bast fibers away from the spiked cylinder and throws them forward.

As part of the first stage core separation process, the bast fibers which thrown from the second rotating cylinder assembly land upon a set of inclined moving conveyor surfaces (20). Each moving conveyor is provided with a plurality of openings across virtually the entire surface thereof, each of said openings having a small dimension. The conveyors shake and throw the fibers vigorously. Through this action, the heavier core fibers fall through the openings leaving the bast fibers on top of the conveyors, resulting in further separation. As discussed previously, the core fibers then travel through a separate series of suction tubes (19) to a rotating core fiber sizer (discussed more fully below).

The bast fibers are then introduced into a second stage core separator (25). The second stage core separator is virtually identical to the first, including a pair of cylinder assemblies, one having spiked teeth (26) and the other (28) for throwing the bast fiber onto another set of inclined moving conveyors (30). Additional core fibers are separated through the grooved grate of the second stage core separator in the same way as the first stage core separator. A series of moving conveyors having the same sized openings therein is also provided for further separation of the fibers through vigorous action.

An air suction mechanism (40) is then employed to remove the fibers from the second stage core separator (see FIG. 2) and deposited them into a first incline core separator (41). The incline core separator is comprised of a plurality of rotating spiked cylinders (42) mounted at an inclined angle of less than 60 degrees. Each of the cylinders is mounted slightly above a rigid grid bar section (43), and all cylinders rotate in the same direction. Small openings are provided between the grid bars in each of the sections. As the fiber is worked up the incline core separator by the rotating cylinders, some of the remaining core falls through the grid bars as the result of both gravity and a small amount of air suction drawing on the underside of the incline separator. The longer base fiber is dispensed out of the top of the first incline core separator and falls via gravity into a second incline core separator (51). As discussed previously, the core fibers which fall through the grid bars travel through a separate series of suction tubes (19) to a rotating core fiber sizer (discussed more fully below).

The second incline core separator (51) is identical to the first, with the exception that the openings between the grid bars of the second incline are narrowed to approximately one-half the size of the openings in the first incline core separator. As before, the rotating action of the spiked cylinders (52) works the fiber up along the tops of the cylinders, and more of the core is separated and falls through the openings in the grid bars (53).

The bast fiber which exits the second incline core separator next travels via gravity into a single saw cleaner mechanism (55). Here the fiber comes into contact with a cylinder (56) around which a saw wire has been spirally wrapped. The saw wire wraps are spaced a pre-determined distance apart in order to maximize the cleaning process. The saw wire itself is provided with teeth along its entire length; thus, when the saw wire is spirally wrapped around the cylinder, it provides the cylinder with a plurality of spaced teeth. The spacing of the teeth on the saw and the wrapping distance may be adjusted in order to prevent the core fibers from becoming caught up in the teeth on the cylinder. As the fibers come into contact with the cylinder of the saw cleaner, a further separation of bast and core fibers occurs as the smaller core fibers become caught up in the teeth of the cylinder. The feed rollers of the single saw cleaner apply the fibers to the saw at a rate whereby the fibers are not broken or shortened.

The rotating cylinder, with saw teeth, pulls the fibers down to where the fibers contact stationery grid bars. Centrifugal force then causes the core fibers to separate at the stationary bars from the bast fibers with the bast fibers being discharged into one pipe and the core fibers into another pipe.

The fibers are next introduced to a jet air fiber separator (60) which blows the fibers at a high rate of speed against the facing edge of an adjustable separating blade (61). The lighter bast fibers flow over the top of the blade and continue to the next step in the process. The heavier core fibers fall below the blade and are carried away to the core fiber sizer.

Finally, the best fiber which exits the jet separator is moved to a four cylinder fiber cleaner (64, see FIG. 3). This mechanism includes four level-mounted spiked cylinders (65) which all rotate in the same direction. Below the cylinders is a set of grid bars (66) spaced one-half inch (½") apart. Core fibers fall through the grid bars, and the bast fiber, now approximately ninety-eight percent (98%) clean is ready to be sent to a bailing machine (70) or single box press (71) for shipment.

Figure 4:
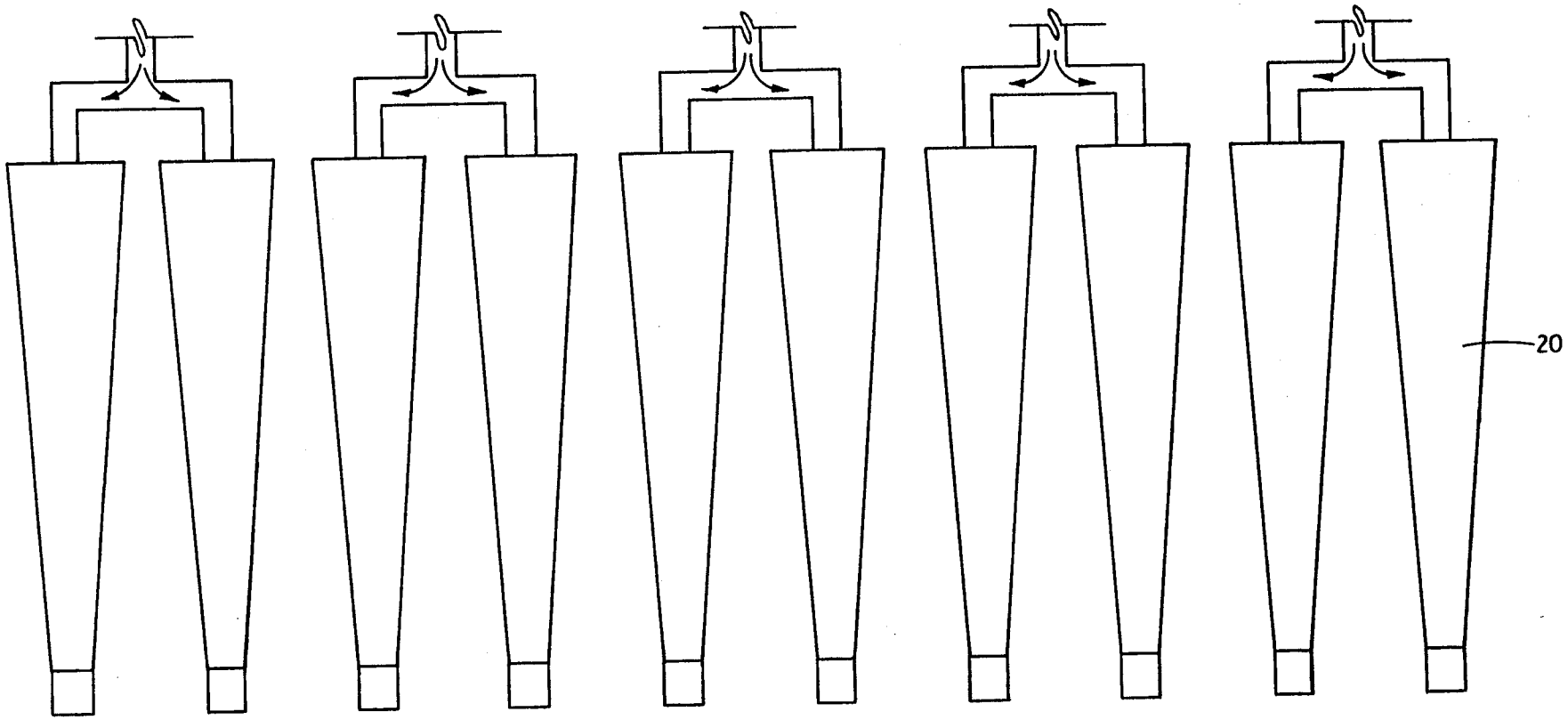
FIG. 4 is a diagrammatic side view of a series of dust cyclones for pulling the core fibers out of the processing machines.
Figure 5:
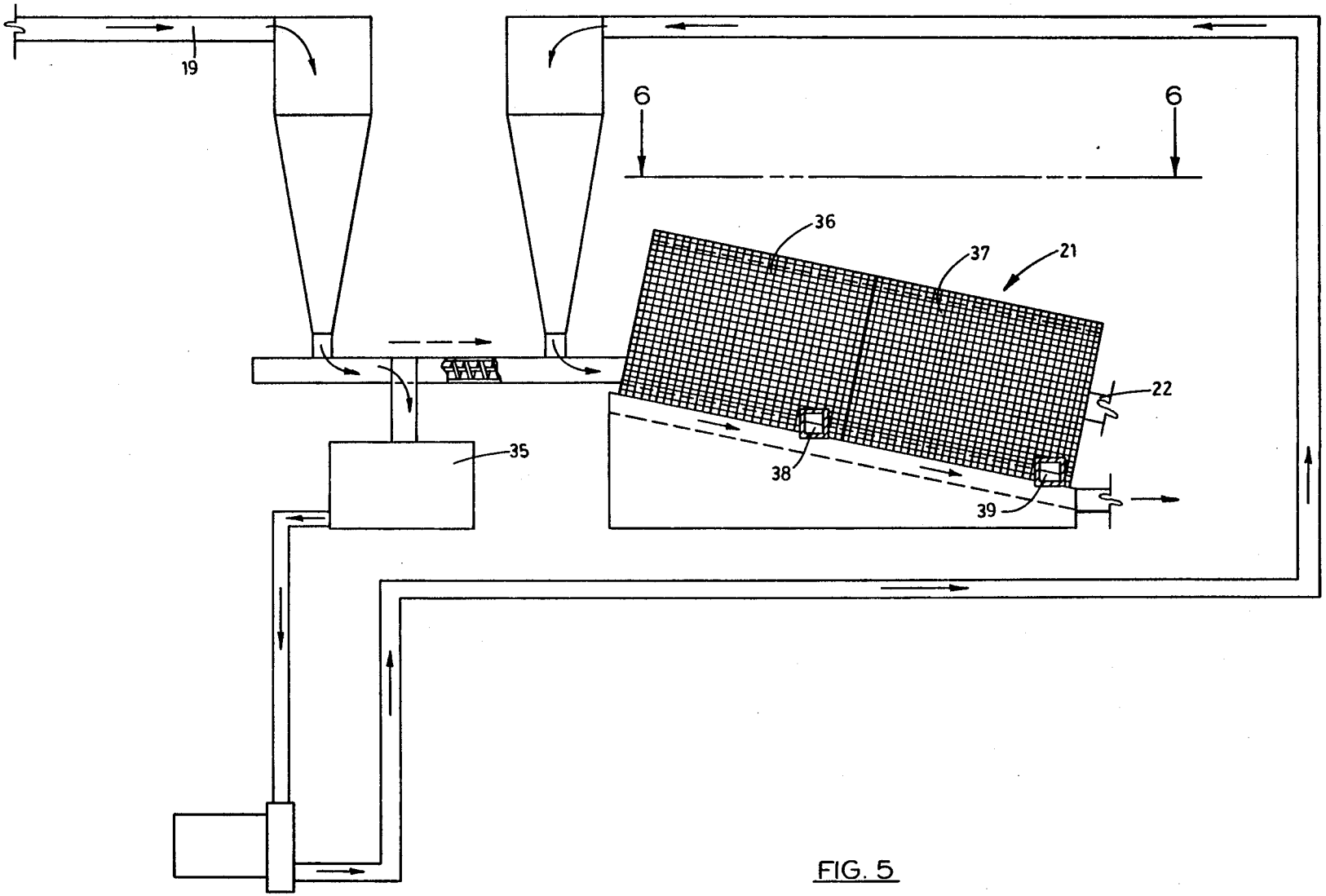
FIG. 5 is a diagrammatic side view of the dust cyclones, hammermill, and rotary drum screen core fiber sizer.
Figure 6:
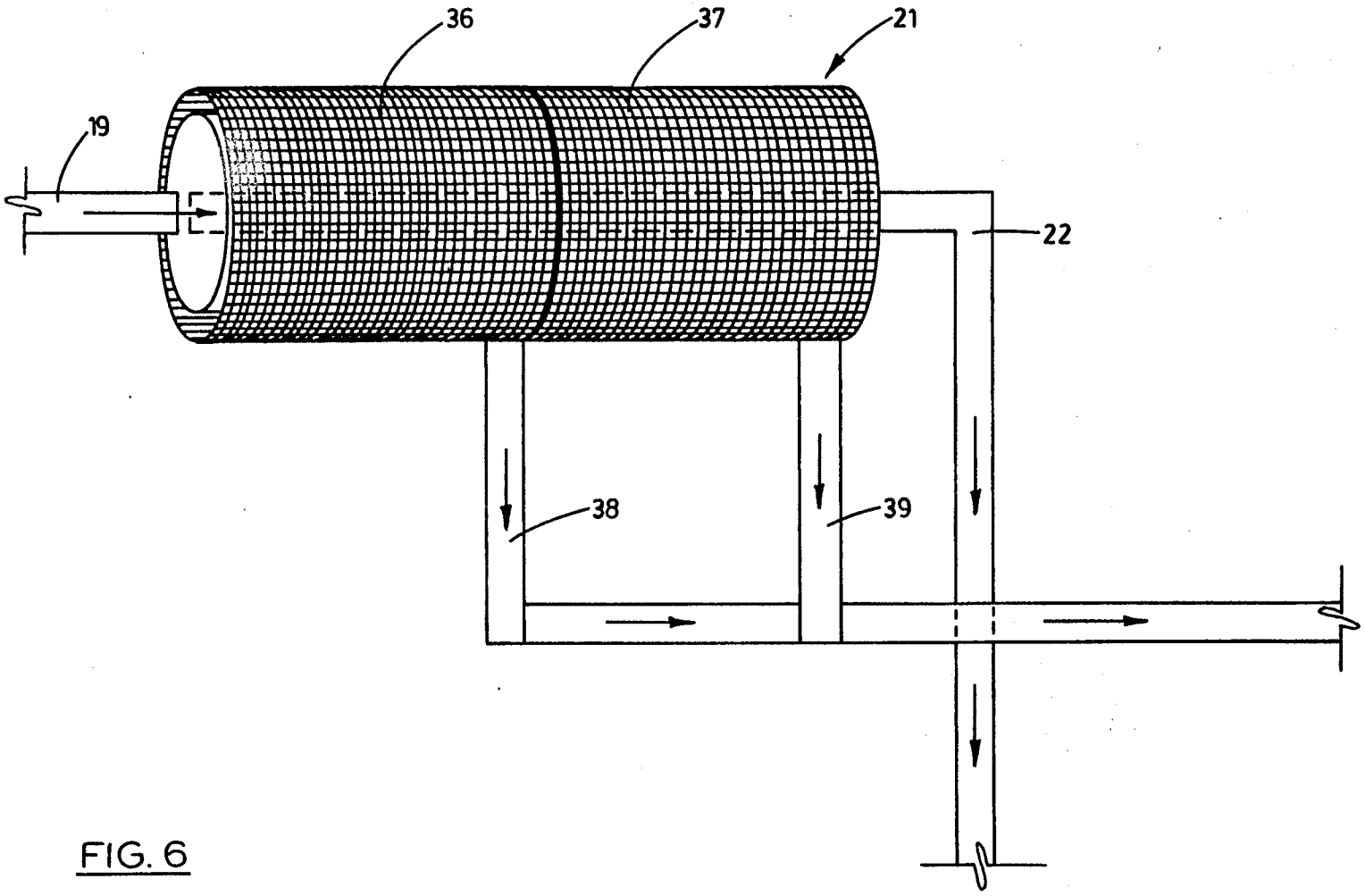
FIG. 6 is a diagrammatic side view of the drum screen core fiber sizer and output channels.
Figure 8:
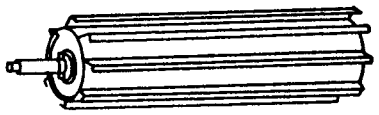
FIG. 8 is a perspective view of rotating cylinder of the first and second stage core separators (18, 28) showing its uneven surface.
Figure 7:
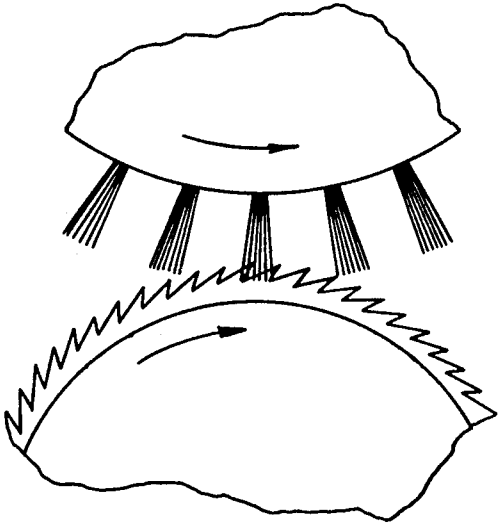
FIG. 7 is a detailed diagrammatic side view of the sawtooth spiked wire and brushes inside the saw cleaner.
Figure 9:
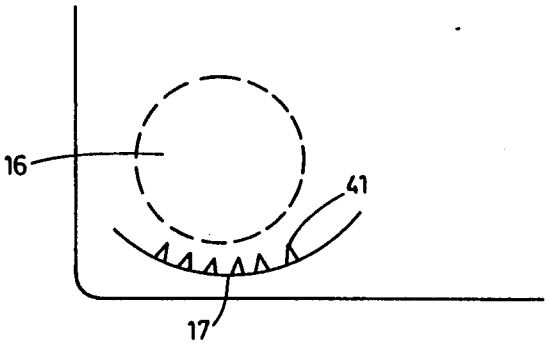
FIG. 9 is a detailed diagrammatic side view of the rotating spiked cylinder and housing of the first stage core separator.

The core fibers which exit the various separators of the process are all channeled via dust cyclones (20) into a collector which deposits the core fibers into a hammermill (see FIGS. 4 and 5). The hammermill (35) is adjusted to grind the fibers to an average size of one-half inch (½"). The ground core fibers are then transported into a large tilted rotating screened core fiber separation drum (21). The screen around the upper half of the drum (36) has openings that are slightly larger than those of the screen around the lower half of the drum (37). As the core fibers are tossed about inside the screened drum, the more coarse core fibers fall through the upper screen (38), the less coarse core fibers fall through the lower screen (39), and the very fine core fibers exit out of the bottom end of the drum. Some bast fibers are also separated from the core fibers here (22) and returned to the main process for bailing.

DESCRIPTION OF THE PREFERRED EMBODIMENTS

In the preferred embodiment, the method of separating the bast and core fibers begins with harvesting the herbaceous plants in the field using a specific cut length of no less than three inches (3") but no more than eight inches (8"). The optimum range is between three inches (3") and five inches (5"). Stalks so harvested are compressed into large modules and transported to a processing plant where they are moved through the various processing steps via air suction.

In the preferred embodiment, five (5) moving conveyors (20, 30) are provided in both the first and second stage core separators, each moving conveyor (20, 30) having a plurality of openings across surface thereof, said openings having a preferred size of one and one-half inch (1½") by two inches (2").

In the preferred embodiment, the first incline core separator is comprised of seven (7) spiked cylinders (42) mounted at an inclined angle of approximately 35 degrees. However, the angle may be adjusted to as much as 60 degrees for optimum performance. Each of the cylinders is mounted approximately one-fourth lens (¼") above a rigid grid bar section (43). The openings between the grid bars in each of the sections (43) is approximately one inch (1"). The openings between the grid bars of the second incline (51) are narrowed to approximately one-half inch (½").

In the preferred embodiment, the spacing of the saw wire wraps around the cylinder (56) is about one inch (1") in order to maximize the cleaning process; and the saw wire itself is provided with three (3) teeth per inch (1") along its entire length. The four cylinders (65) of the fiber cleaner (64) are mounted approximately one-fourth inch (¼") above the set of grid bars (66) in the preferred embodiment. The grid bars themselves are spaced one inch (1") apart.

The larger screen of the rotary drum (36) has openings of approximately three quarter inch (¾"), and the smaller screen (37) has openings of approximately one eighth inch (⅛").

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A method for separating the long outer bast fibers from the short woody inner core fibers of herbaceous fiber producing plants comprising the steps of:

a. harvesting the plants using a short cut length;

b. introducing the plants so harvested into a first core separator wherein the harvested plant fibers come into contact with a rotating spiked cylinder partially surrounded by a concave grated housing, said cylinder mounted adjacent to a means for producing air flow, said means mounted adjacent to a plurality of upwardly inclined moving conveyor surfaces having openings therein, whereby many of the woody innercore plant fibers are caught by the spikes in said cylinder and thrown through said grated housing leaving the longer outer bast fibers to pass onto said moving conveyor by said air flow means such that as said conveyors move said fibers upward, many more of the woody innercore fibers drop through the openings therein; then c. introducing the bast fibers output from the first core separator into an identical second core separator; and then d. introducing the bast fibers from the previous step into a first incline separator wherein the fibers come into contact with a plurality of synchronously rotating spiked cylinders mounted adjacent to each other on an incline and above a set of grid bars having openings between them wherein, as the bast fibers are worked upward on the spiked cylinders, innercore fibers are removed and drop through the grid bar openings; then e. introducing the bast fibers output from the first incline separator into a second incline separator which is identical to the first incline separator except that the openings between the grid bars of said second incline separator are more narrow than the openings between the grid bars of the first incline separator; and then f. introducing the bast fibers from the previous step into a saw cleaner wherein the fibers come into contact with a cylinder around which a spiked wire has been tightly wrapped, said cylinder mounted above a set of stationary grid bars, so that centrifugal force throws the innercore fibers through the grid bars and the separated bast fibers exit the saw cleaner; then g. introducing the bast fibers from the previous step into a jet air fiber separator wherein the fibers are blown against the facing edge of an adjustable blade for separation; then h. introducing the bast fibers from the previous step into a four cylinder fiber cleaner wherein the fibers come into contact with four (4) synchronously rotating level-mounted spiked cylinders which are mounted above a set of horizontal grid bars under which a suction is applied, so that any remaining innercore fibers fall through the grid bars and very clean bast fibers exit the cleaner.

2. The method according to claim 1 wherein a plurality of inwardly protruding spikes are mounted on the housings adjacent to the spiked cylinders of the first and second core separators.

3. The method according to claim 2 wherein the cut length of the harvested plants is between three inches (3") and eight inches (8").

4. The method according to claim 3 wherein the harvested plants are introduced to the first core separator by vacuum suction, and the means for producing air flow in said first and second core separators is a rotating cylinder having an uneven surface thereon.

5. The method according to claim 4 wherein the innercore fibers produced are transported via air suction to a hammermill for grinding and then to a tiled rotating screened drum for sizing.

6. The method according to claim 5 wherein the openings in the screens around the upper half of the tilted rotating drum are wider than the openings in the screens around the lower half thereof.

7. The method according to claim 6 wherein the openings in the inclined moving conveyor surface of the first and second core separators are approximately one and one-half inch (1½") by approximately two inches (2").

8. The method according to claim 7 wherein seven (7) rotating spiked cylinders are provided in the first and second incline separator.

9. The method according to claim 8 wherein the rotating spiked cylinders provided in the first and second incline separator are tilted at an angle of less than sixty (60) degrees.

10. The method according to claim 9 wherein the grid bars are located approximately one quarter inch (¼") below the rotating spiked cylinders provided in the first and second incline separators.

11. The method according to claim 10 wherein the distance separating the grid bars below the rotating spiked cylinders provided in the first incline separator is approximately one inch (1"), and the distance separating the grid bars below the rotating spiked cylinders provided in the second incline separator is approximately one-half inch (½").

12. The method according to claim 11 wherein approximately three (3) spikes per inch are provided in the spiked wire of the saw cleaner.

13. The method according to claim 12 wherein the wraps of the spiked wire around the cylinder of the saw cleaner are approximately one inch (1") apart.

14. The method according to claim 13 wherein the level-mounted cylinders of the fiber cleaner are mounted approximately one quarter inch (¼") above the grid bars thereof.

15. The method according to claim 14 wherein the horizontal grid bars of the fiber cleaner are separated by a distance of approximately one inch (1").

16. The method according to claim 15 wherein the rotating spiked cylinders provided in the first and second incline separator are tilted at an angle of approximately thirty-five (35) degrees.

17. The method according to claim 16 wherein the openings in the screens around the upper half of the tilted rotating drum are approximately one-half inch (½") in diameter, and the openings in the screens around the lower half thereof are approximately one-eighth inch (⅛") in diameter.

18. The method according to claim 2 wherein the cut length of the harvested plants is between three inches (3") and five inches (5").

* * * * *